US007025173B2

(12) United States Patent
Nir

(10) Patent No.: US 7,025,173 B2
(45) Date of Patent: Apr. 11, 2006

(54) RESCUE SYSTEM FOR HIGH-RISE BUILDINGS

(76) Inventor: Eliyahu Nir, 4 Zommerstein Street, 42446 Netania (IL)

( * ) Notice: Subject to any disclaimer, the term of this patent is extended or adjusted under 35 U.S.C. 154(b) by 0 days.

(21) Appl. No.: 10/214,122

(22) Filed: Aug. 8, 2002

(65) Prior Publication Data

US 2004/0060772 A1 Apr. 1, 2004

(51) Int. Cl.
*A62B 1/20* (2006.01)

(52) U.S. Cl. ..... 182/48

(58) Field of Classification Search ..... 182/48
See application file for complete search history.

(56) References Cited

U.S. PATENT DOCUMENTS

| | | | | | |
|---|---|---|---|---|---|
| 132,073 | A | * | 10/1872 | Herold | 182/49 |
| 208,470 | A | * | 10/1878 | Puchs | 193/25 R |
| 291,756 | A | * | 1/1884 | Moore et al. | 193/27 |
| 293,707 | A | * | 2/1884 | Bradley | 182/48 |
| 318,299 | A | * | 5/1885 | Samper | 182/48 |
| 495,955 | A | * | 4/1893 | Bouvier | 182/48 |
| 550,310 | A | * | 11/1895 | Woodward | 193/25 R |
| 908,034 | A | * | 12/1908 | Pyleck | 182/48 |
| 1,520,440 | A | * | 12/1924 | Pyleck | 193/25 R |
| 2,101,284 | A | * | 12/1937 | Simpson | 182/48 |
| 4,240,520 | A | | 12/1980 | LaGrone et al. | |
| 4,339,019 | A | * | 7/1982 | Tracy | 182/47 |
| 4,398,621 | A | | 8/1983 | Baker | |
| 4,580,659 | A | | 4/1986 | Baker | |
| 6,057,879 | A | * | 5/2000 | Weber | 348/81 |
| 6,401,901 | B1 | * | 6/2002 | Bracken et al. | 193/38 |

FOREIGN PATENT DOCUMENTS

GB 2232138 A * 12/1990

* cited by examiner

*Primary Examiner*—Alvin Chin-Shue

(57) ABSTRACT

A system for the evacuation of individuals trapped in multiple story buildings by gliding down a rescue sleeve. The sleeve (12) is composed of sections (20), each section being made of a sheet material strengthened by a circumferential rigid support member (22), the sections are connected to each other to form a continuous envelope. At least a pair of cables (26; 27) are provided, thread along the sleeve, one (26) at the bottom and one (27) at the top generatrix thereof. A pair of winch systems (52; 54) are provided for winding the cables (26; 27) into a dedicated location (50) at the building story from which rescue is requested, so that the sleeve (12) becomes folded into a compact package. Coil springs (60; 62) are used for selectively ejecting and unfolding the sleeve down to ground level where it becomes tied to stationary objects (16; 17).

15 Claims, 11 Drawing Sheets

RESCUE SYSTEM FOR HIGH-RISE BUILDINGS

FIELD OF THE INVENTION

The present invention relates to rescue systems for evacuating individuals trapped in high-rise buildings in case of an emergency situation, typically fire.

More specifically the invention concerns fire escapes using chutes or tubes through which individuals glide down from the building.

BACKGROUND OF THE INVENTION

The first known attempts to tackle the problem at hand are disclosed in and by U.S. Pat. No. 908,034 (Dec. 29, 1908) and U.S. Pat. No. 1,520,440 (Dec. 23, 1924), both to Frank Pyleck and entitled "Automatic Fire-Escape".

In the first Patent there was described a foldable chute normally stored in a box that is hingedly supported. In the standby position, the box is arrested against the outer wall of the building, at one side of a window. When needed, the box is released and allowed, under the bias of springs, to smash into and is break open the window. The chute becomes released and projects down. The ejection of the chute, as well as its support in a sloping down to ground level position, are sustained by a coil spring wound around the chute along its entire length, while the exit side is freely rested on the ground.

Further disclosed were a pair of cords passed along the chute by which the chute can be collapsed and folded back into the storage box.

In the second, later Patent, the inventor proposed to substitute the supporting coil spring by a solid track or rail permanently mounted to the building wall above the window and inclining down parallel to the path of the unfolded chute. The chute, after being deployed will be suspended from the rail by a series of wheeled hangers running along the rail.

Quite obviously, these solutions might have been of some merit at the beginning of the past century with regard to buildings of, say, four or five stories at the most, but out of the question for modern hi-rise buildings. Hence, and only quite recently, other solutions have been proposed—cf. U.S. Pat. No. 4,099,596 (1978); U.S. Pat. No. 4,240,520 (1980); U.S. Pat. No. 4,398,621 (1983), and U.S. Pat. No. 4,580,659 (1986), each one pointing in a different direction and none of them known to have gained commercially successful implementation.

It is therefore the general object of the present invention to overcome the deficiencies of the prior art chute-gliding fire-escape systems.

It is a further object of the invention to employ a tension cable as the only supporting means of the sliding sleeve.

It is a still further object of the invention to provide delimiting stretches of cables, associated with the same tension cable for forming knee-like sections along the sleeve for locally moderating the inclination angle thereof.

SUMMARY OF THE INVENTION

The invention provides a system particularly useful for the evacuation of individuals from an elevated level of a building, comprising: a flexible sleeve capable of being folded into a compact storage form, or unfolded into an extended operative form defining a tube for guiding the descent of an individual therethrough; the flexible sleeve having an entry end to be secured to the building at the elevated level, and an exit end to be secured to a stable object at a lower level in the extended operative form of the flexible sleeve.

According to one aspect of the present invention, the flexible sleeve includes a plurality of annular sections interconnected together, each section being made of strong flexible sheet material attached to and supported by a rigid ring; each of at least some of the rigid rings spaced along the length of the flexible sleeve carrying an eyelet extending upwardly from an upper portion of the respective rigid ring; a tension cable passing through the eyelets, one end of the tension cable being fixed to the rigid ring at or adjacent to the exit end of the flexible sleeve, and the opposite end of the tension cable passing through the eyelet carried by the rigid ring at or adjacent to the entry end of the flexible sleeve for securement with respect to the building; and at least one anchoring cable having one end to be secured to said tension cable at or adjacent to the exit end of the flexible sleeve in the extended operative form of the flexible sleeve, and an opposite end to be secured to the stable object at the lower level.

According to another aspect of the present invention, the flexible sleeve includes a plurality of annular sections interconnected together, each section being made of strong flexible sheet material attached to and supported by a rigid ring; each of at least some of the rigid rings carrying an eyelet extending upwardly from an upper portion of the respective rigid ring, an upper tension cable passing through the upwardly-extending eyelets, one end of the upper tension cable being fixed to the respective rigid ring at or adjacent to the exit end of the flexible sleeve, and the opposite end of the upper tension cable passing through the eyelet carried by the respective rigid ring at or adjacent to the entry end of the flexible sleeve for securement with respect to the building; a compartment for receiving the flexible sleeve when in its compact storage form; a backing plate displaceable within the compartment; and a winch in the compartment secured to said opposite end of the upper tension cable such that operation of the winch, while the flexible sleeve is in its extended operative form, draws the annular sections of the flexible sleeve into the compartment against said displaceable backing plate and folds the annular sections into the compact storage form.

According to a further aspect of the present invention, the flexible sleeve includes a plurality of annular sections interconnected together, each section being made of strong flexible sheet material attached to and supported by a rigid annular ring, and a plurality of interconnected semi-annular sections at the exit end of the flexible sleeve, each including flexible sheet material attached to and supported by a semi-annular ring; each of at least some of the rigid annular rings carrying an eyelet extending upwardly from the upper portion of the respective ring; each of at least some of the annular and semi-annular rings carrying an eyelet extending downwardly from a lower portion of the respective ring; an upper tension cable passing through the upwardly-extending eyelets; and a lower tension cable passing through the downwardly-extending eyelets, with one end of each cable being fixed to the respective ring at or adjacent to the exit end of the flexible sleeve, and the opposite end of each tension cable passing through the eyelet carried by the ring at or adjacent to the entry end of the flexible sleeve for securement with respect to the building.

Further novel features and other objects of this invention will become apparent from the following detailed description, discussion, and the appended claims taken in conjunction with the accompanying drawings.

DETAILED DESCRIPTION OF THE PREFERRED EMBODIMENTS

Figure 1:
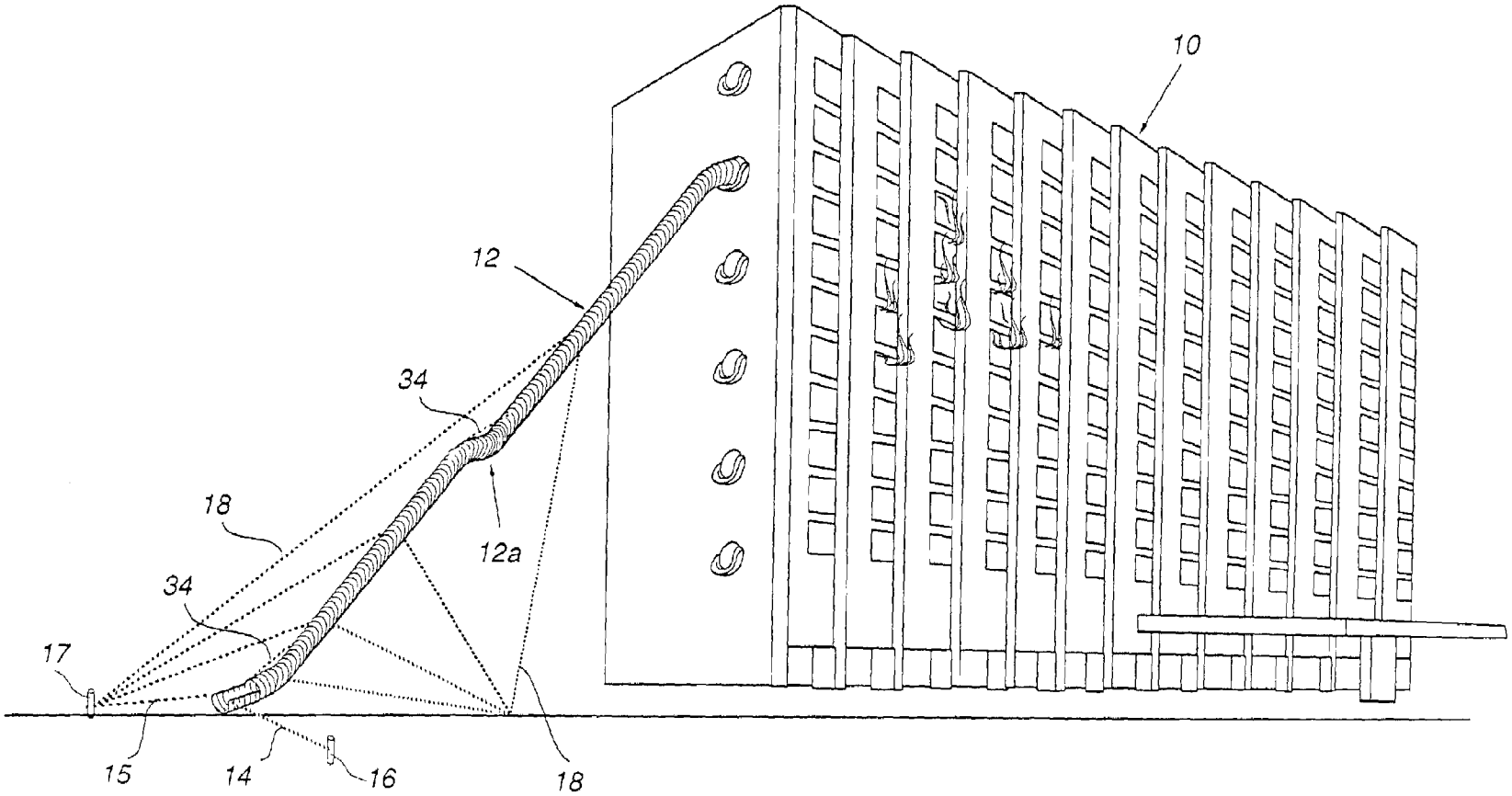
FIG. 1 is a schematic perspective view of the emergency rescue system in the operative position thereof.
Figure 8:
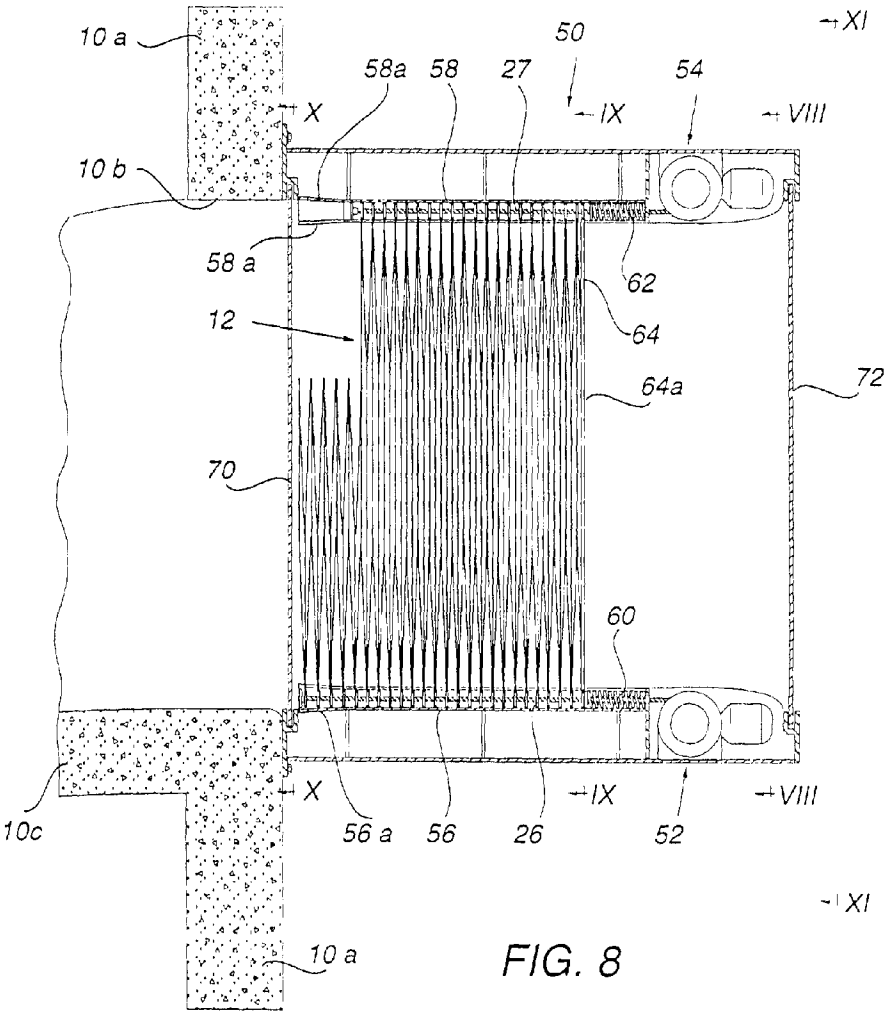
FIG. 8 is a view taken along line VIII—VIII of FIG. 7.
Figure 7:
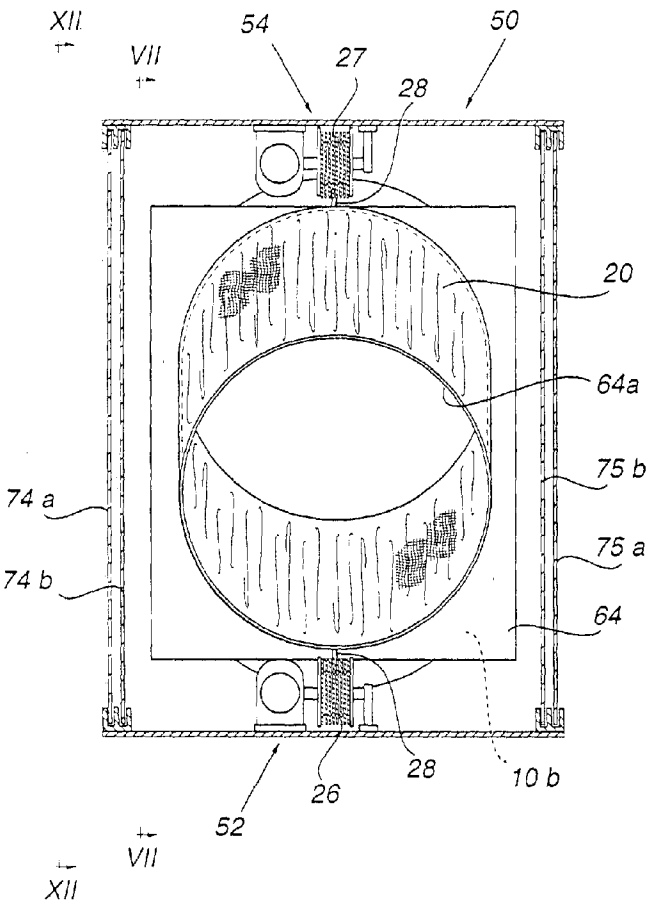
FIG. 7 is a partly sectional side view of the sleeve-storing compartment, taken along line VII—VII of FIG. 8.
Figure 10:
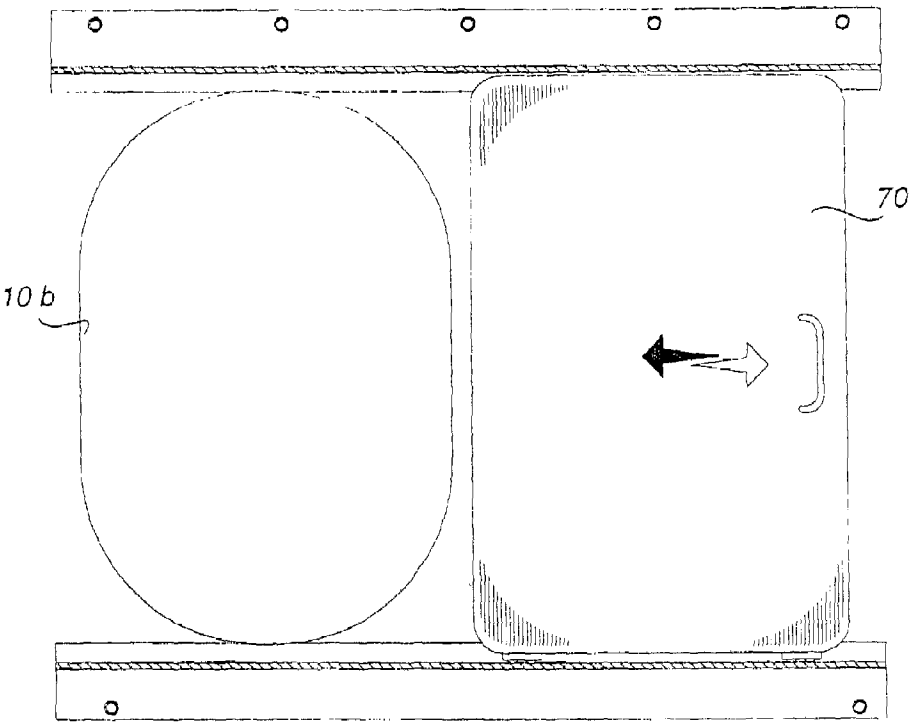
FIG. 10 is a view taken along line X—X of FIG. 7.
Figure 9A:
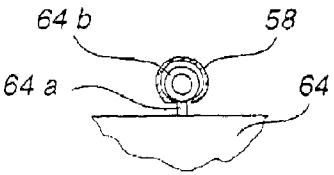
FIG. 9*a* is a detail of construction relating to FIG. 9.
Figure 9:
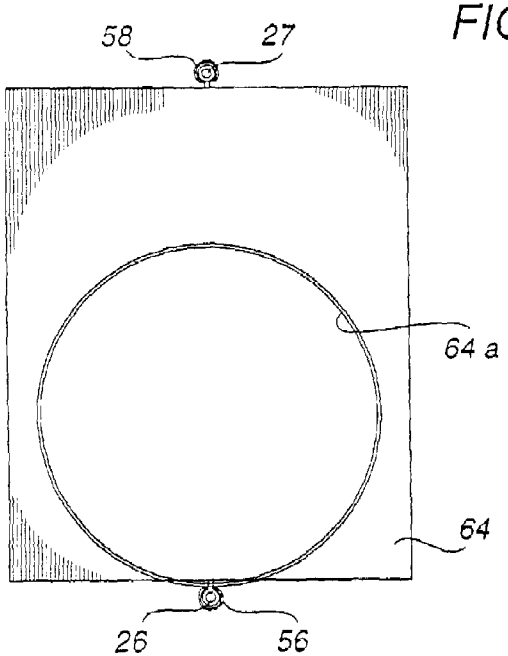
FIG. 9 is a view taken along line IX—IX of FIG. 7.
Figure 12:
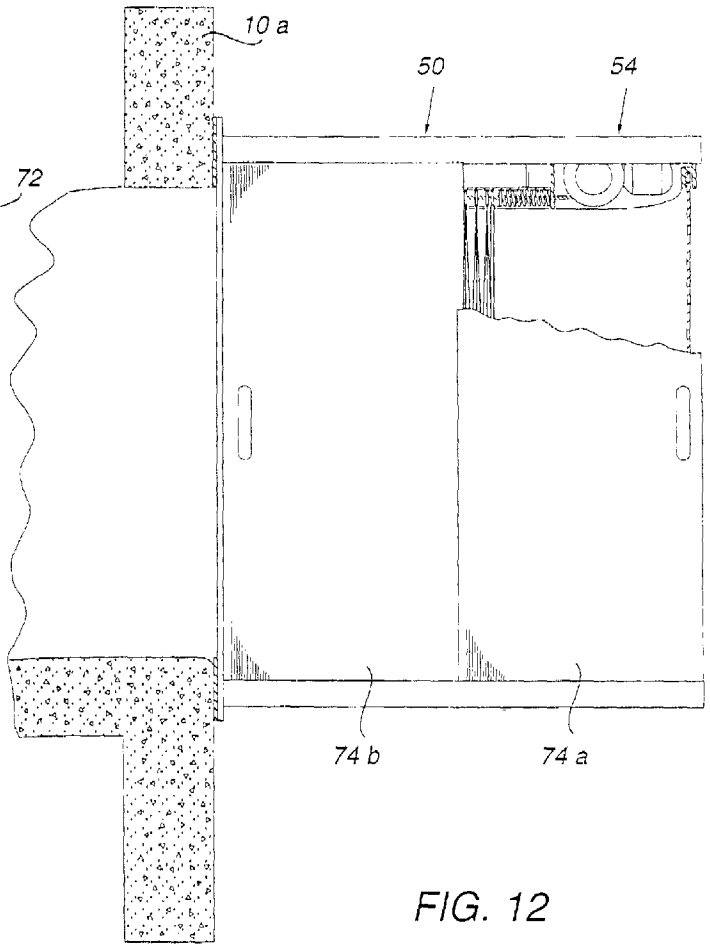
FIG. 12 is a view taken along line XII—XII of FIG. 8.
Figure 11:
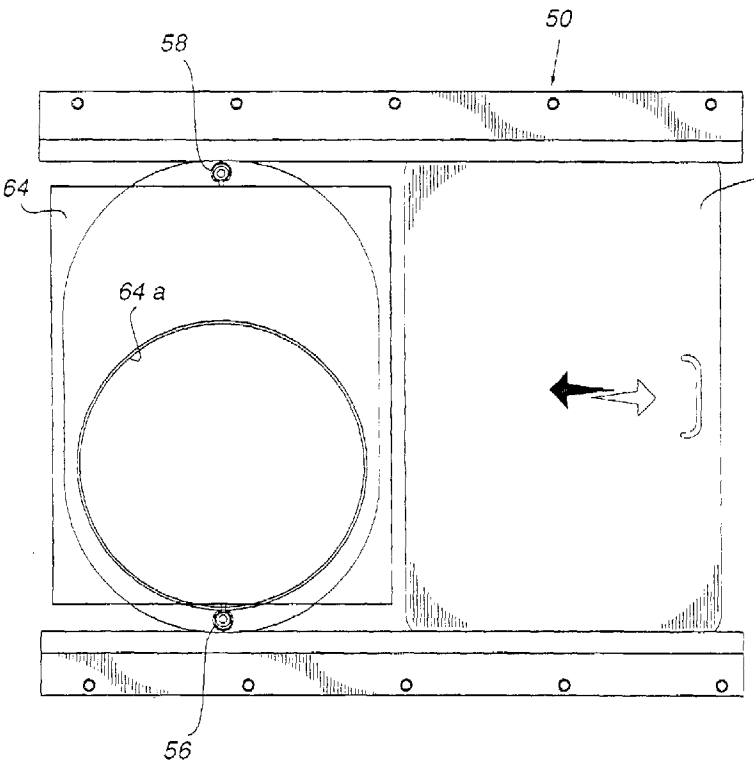
FIG. 11 is a view taken along line XI—XI of FIG. 7.

In FIG. 1 there is illustrated a multiple level building 10 (residential or hotel) equipped with an evacuation system constructed in accordance with the present invention. Such an evacuation system includes a flexible sleeve 12 capable of being folded into a compact storage form (FIG. 8) or unfolded into an extended operative form (FIGS. 1, 13, 14) defining a tube for guiding the descent of an individual. The flexible sleeve 12 has an entry end secured to the building at the elevated level from which individuals are to be evacuated, and an exit end to be secured to a fixed or stable object at a lower level in the extended operative form of the flexible sleeve.

In FIG. 1 the rescue sleeve or chute 12 has been ejected as will be described in greater detail below. The exit end of the sleeve 12 is brought (e.g. by a specially trained rescue team) to a convenient evacuation point, namely one that is as far from the building as allowed by the length of the sleeve on the one hand, and by the surrounding topography (nearby buildings or other obstacles) on the other hand. As already mentioned, the sleeve is self-supported by anchoring the sleeve, e.g., by cables 14 and 15 connecting the exit end of the sleeve to any kind of stable objects such as nearby parked vehicles, trees, street lamp posts and the like, schematically represented by poles 16 and 17. Preferably though, for the sake of better support and greater safety, a number of auxiliary anchor cables 18 should be available and used as shown and will be described further below.

Figures 2, 2A:
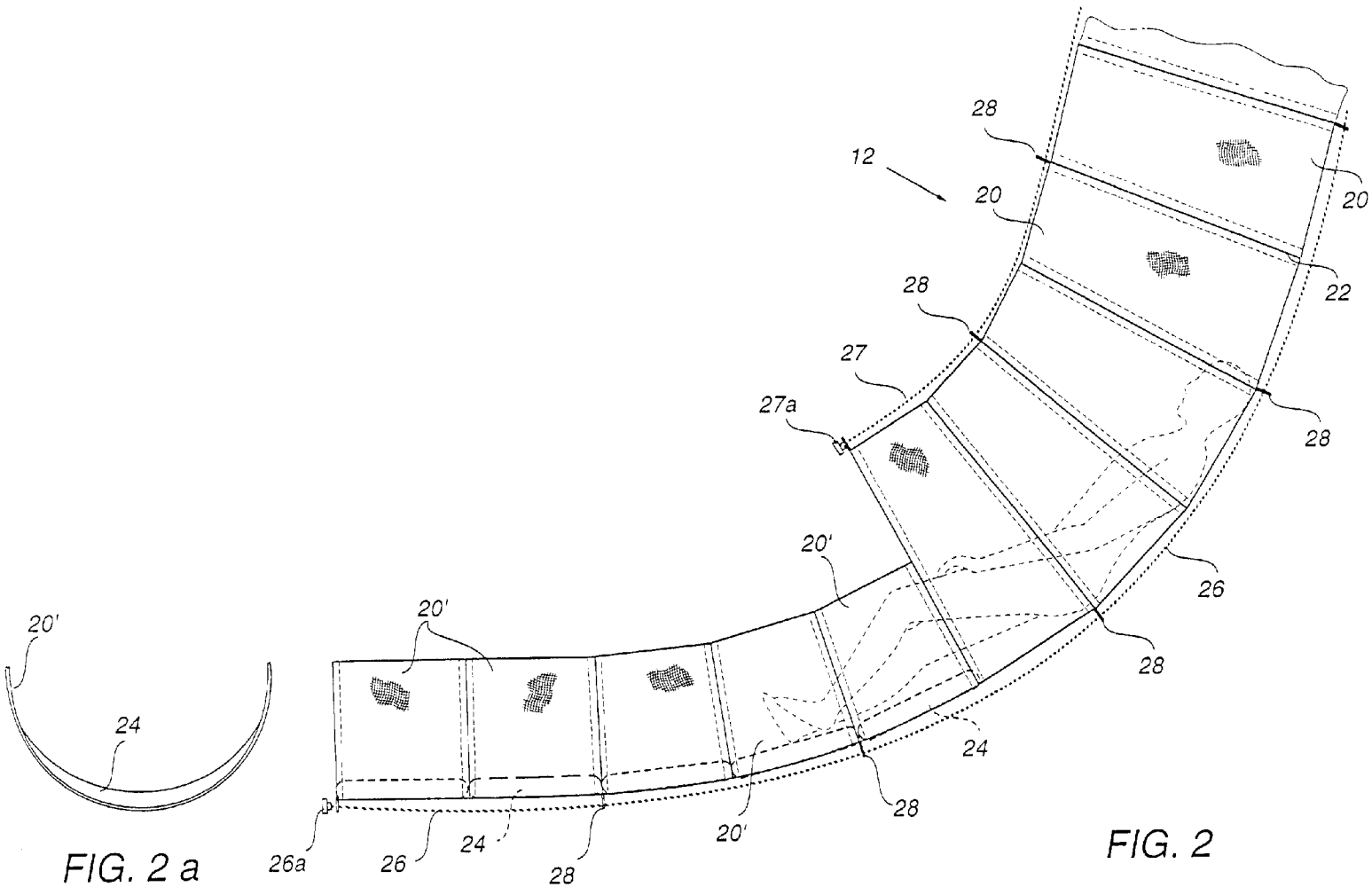
FIG. 2 is an enlarged view of the down-stream end of the rescue sleeve.
FIG. 2*a* is a side view, showing the end side of the sleeve.
Figures 3A, 3B, 3C, 3D:
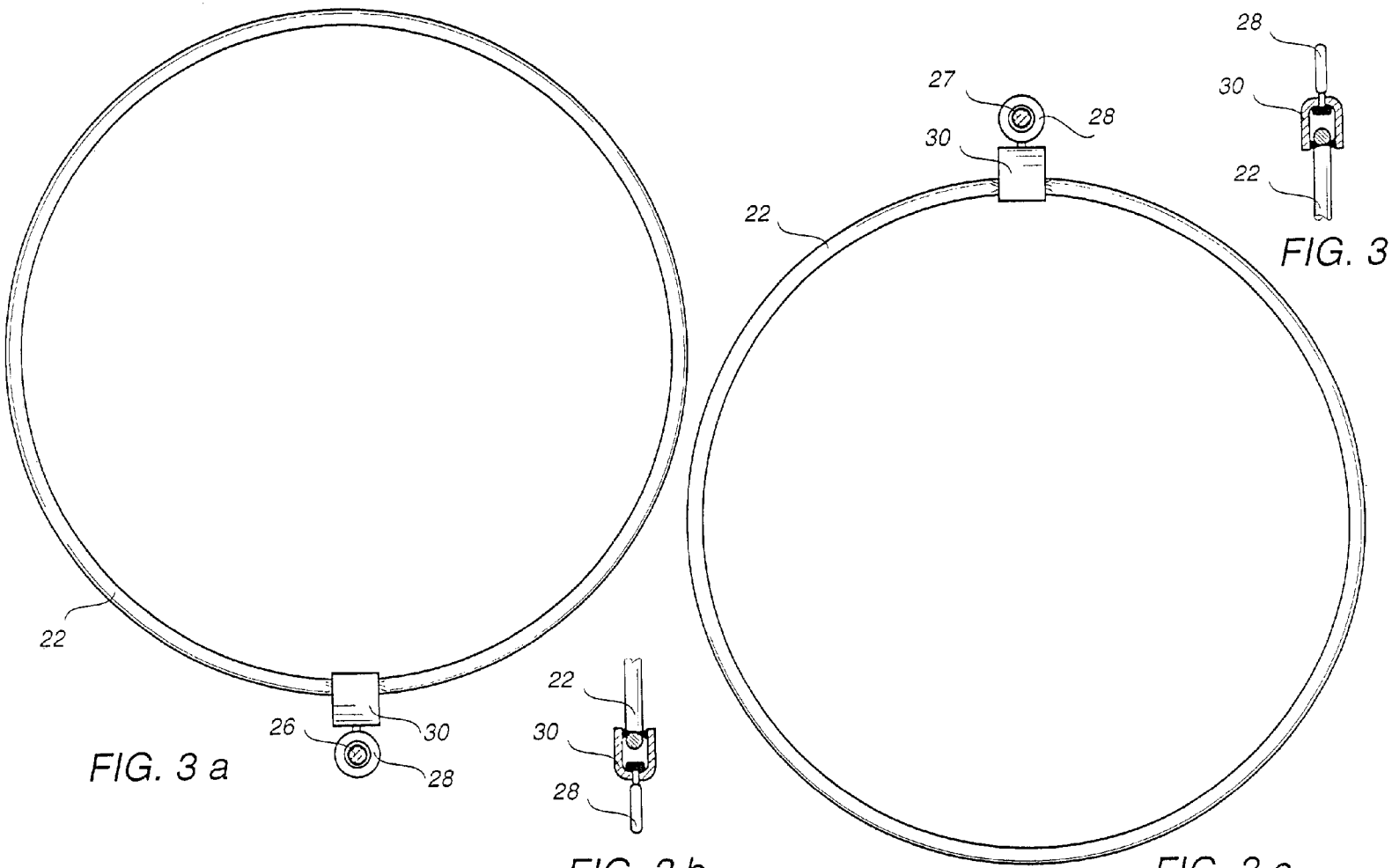
FIGS. 3*a*–3*d* are details of construction relating to the rings interposed between successive sections of the sleeve.
Figure 4B:
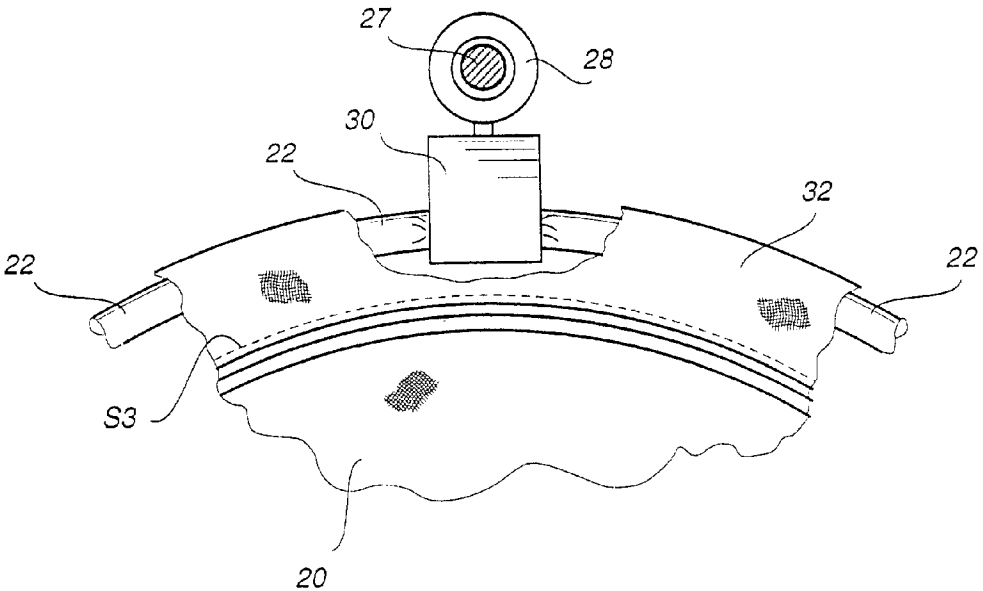
FIG. 4*b* is a partial side view of FIG. 4*a;*
Figure 4A:
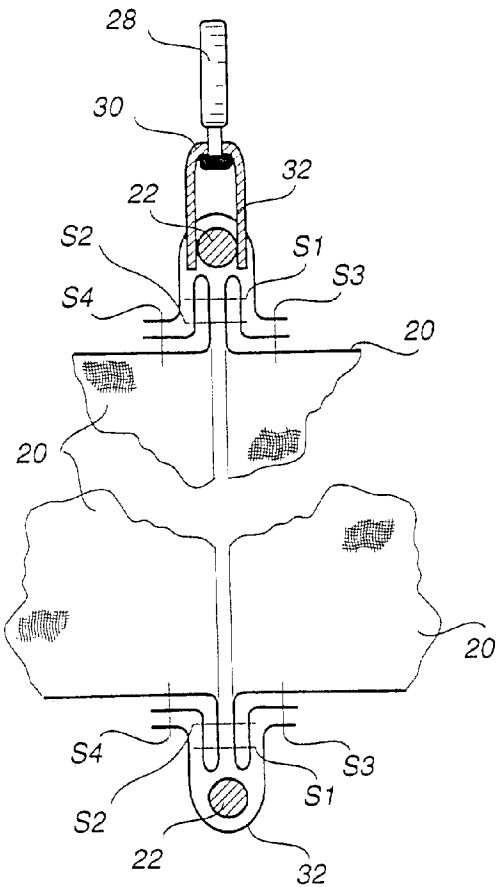
FIG. 4*a* illustrates the connection between adjacent sleeve sections.

It will be further noted (see FIG. 2) that the sleeve 12 is mostly made of tapeworm-like structure, namely a chain of annular interconnected sections 20, which are made of strong, flexible sheet material such as nylon, canvas fabric and the like, sewn to each other and strengthened by rigid annular rings generally denoted 22 e.g., FIGS. 4*a*, 4*b*).

At the exit end, however, the sleeve 12 can be constructed of semi-annular rings so as to define half-open sections 20', and provided with preferably self-inflated cushions 24, intended to brake and absorb the gliding movement o the rescued persons (shown in phantom lines) using the sleeve.

In addition there are provided a pair of tension cables 26, 27, running all along the sleeve 12. Cable 16 runs at the bottom side, threaded through downwardly-extending eyelets 28 carried by lower portions of alternate rings 22. Every eyelet is preferably pivotally connection (FIGS. 3*a*–3*d*) via a U-shaped bracket 30 which is welded to the respective ring 22.

One end of cable 26 is fixed to the ring 22 at the exit end of sleeve 12.

The same arrangement exists with respect to the top running cable 27, which is threaded through upwardly extending eyelets 28 carried by the upper portions of the remaining alternate rings 22 in a staggered fashion relative to cable 26.

Yet another detail of construction is shown in FIGS. 4*a* and 4*b*. This relates to the manner the sleeve sections 20 are sewn to each other and to the rings 22. Hence, the margins of each section are bent radially outwards, folded about themselves and fastened by stitches S1 and S2, leaving an extended portion directed backwards. The ring 22 is then assembled by a circular wrapping 32 of cloth which envelops the ring and is fastened to the said extended portions by stitches S3 and S4.

The brackets 30 for the eyelets 28 will of course penetrate outwards of the envelope 32 (FIG. 4*b*).

Figure 5:
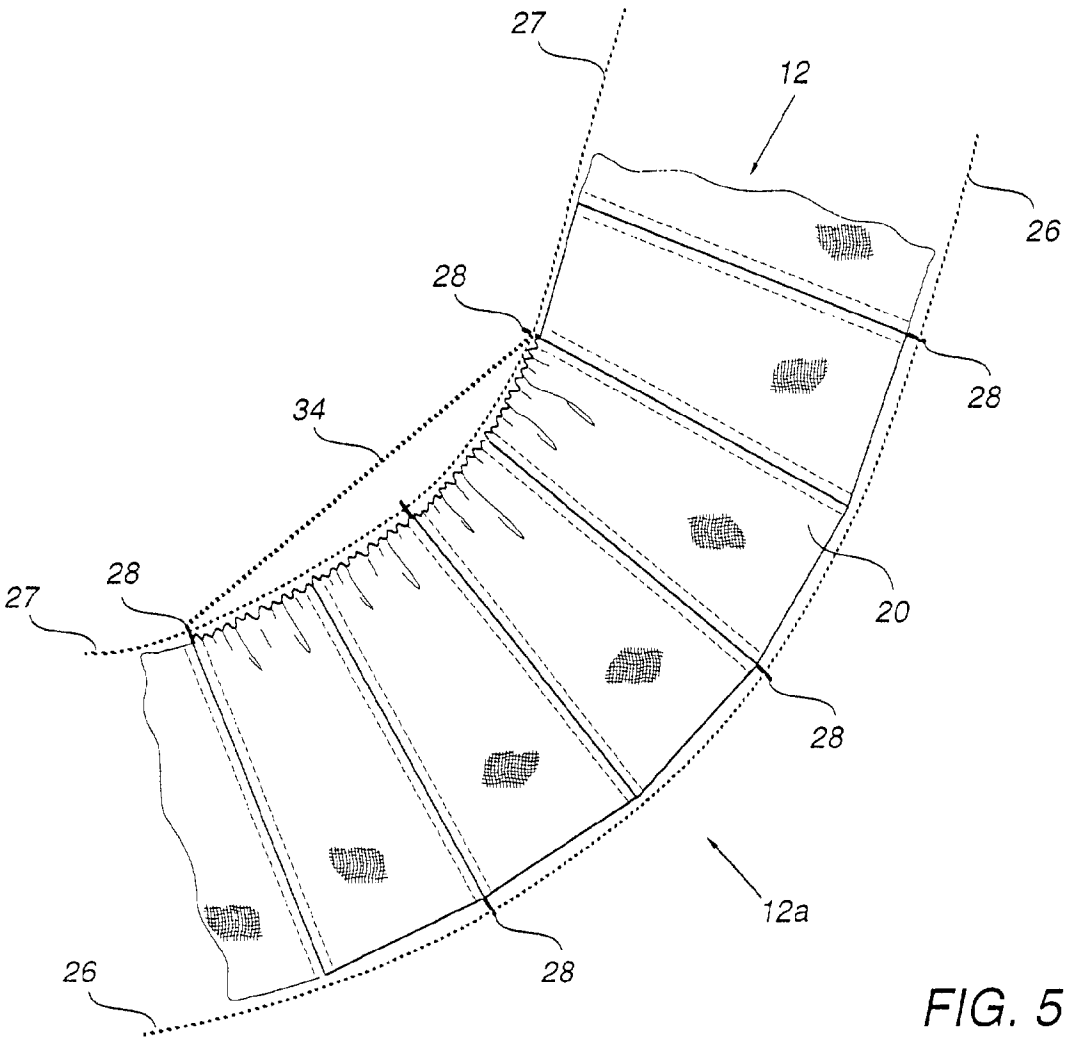
FIG. 5 shows a knee-forming arrangement.

The arrangement of FIG. 5 may be adopted in order to form locally knee-like sections that will serve to moderate the speed of the free gliding persons by constituting successive stretches of less-steep angles. When in the folded state (see below), several stretches of an additional delimiting or constraining cable 34 are tied, at certain intervals each between two spaced eyelets of the top cable 27, restricting the distance between the respective rings at their upper points to a pre-set length. This will constrain the portion of the sleeve between the two eyelets to a predetermined curve and will thereby cause the sleeve 12 to form knee-like sections 12*a* when unfolded. The number of such knee-like sections 12*a* will be determined according to the overall height of the sleeve (i.e., the respective building storey) and the amount of the final desired curvature of the sleeve as a whole.

As already mentioned, auxiliary anchor cables 18 (FIG. 1) may be requested. For that purpose, a second series of swivable eyelets 40 are employed (FIG. 6), A pair of eyelets 40 are carried by the appropriate sides of at least one ring 22, preferably a plurality of such rings, at or adjacent to the exit end of the sleeve and serve a anchoring elements for anchor cables 18.

Figure 6:
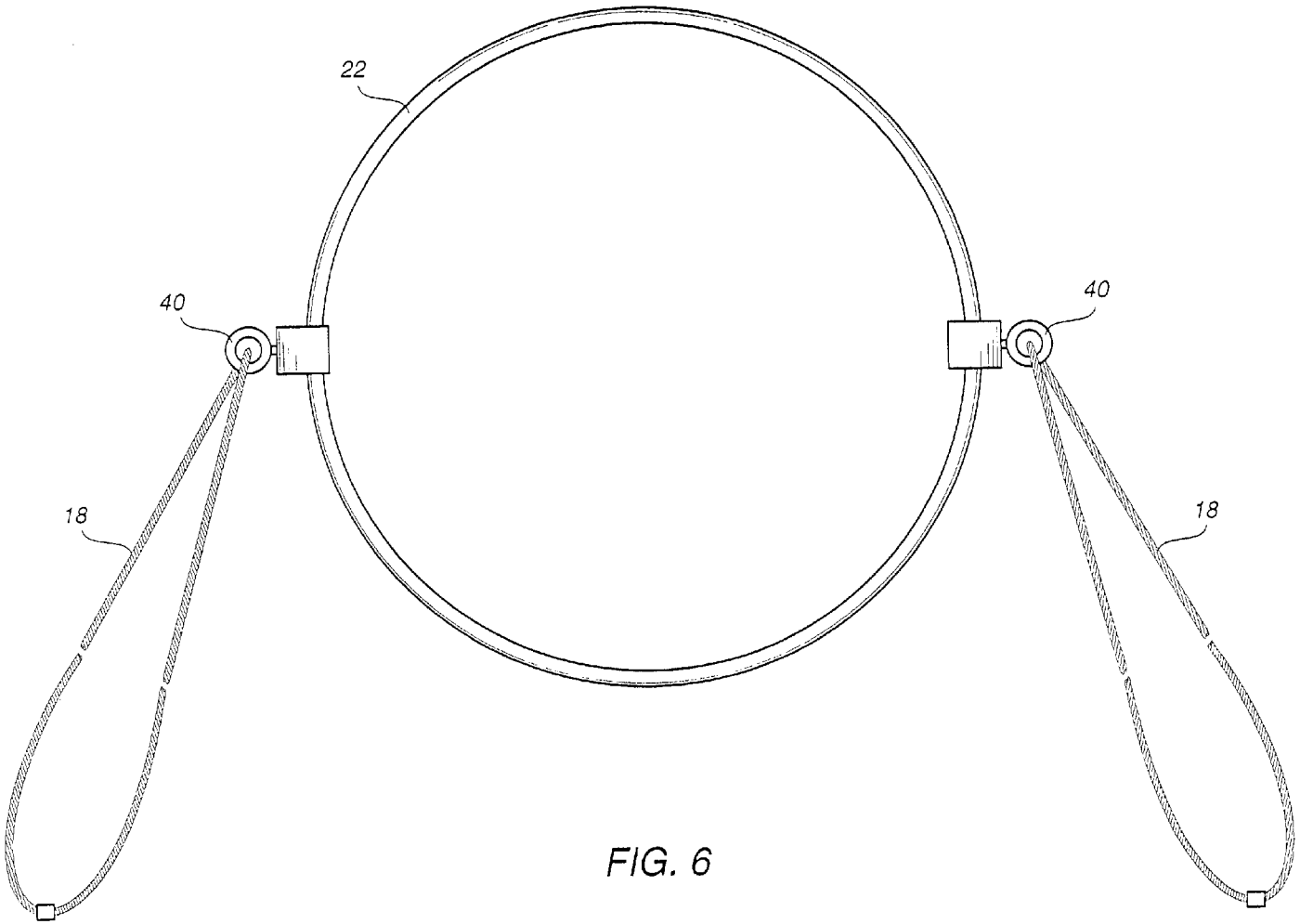
FIG. 6 is a detail of construction relating to the attachment of auxiliary cables.

As further seen in FIG. 6, the eyelet configuration is advantageous, allowing the auxiliary anchor cables 18 be constituted by loops, the idea being that after use, the cables can be cut and completely removed from the sleeve. This is important for facilitating a smooth folding back of the sleeve for re-use (see below), without needing to attend specially to the orderly collection of these cables.

The re-installment of the cables 18 will take place at a later stage, in the folded-back state of the sleeve, through a service opening (sliding doors 74 and 75), as will be described later on.

Figure 13:
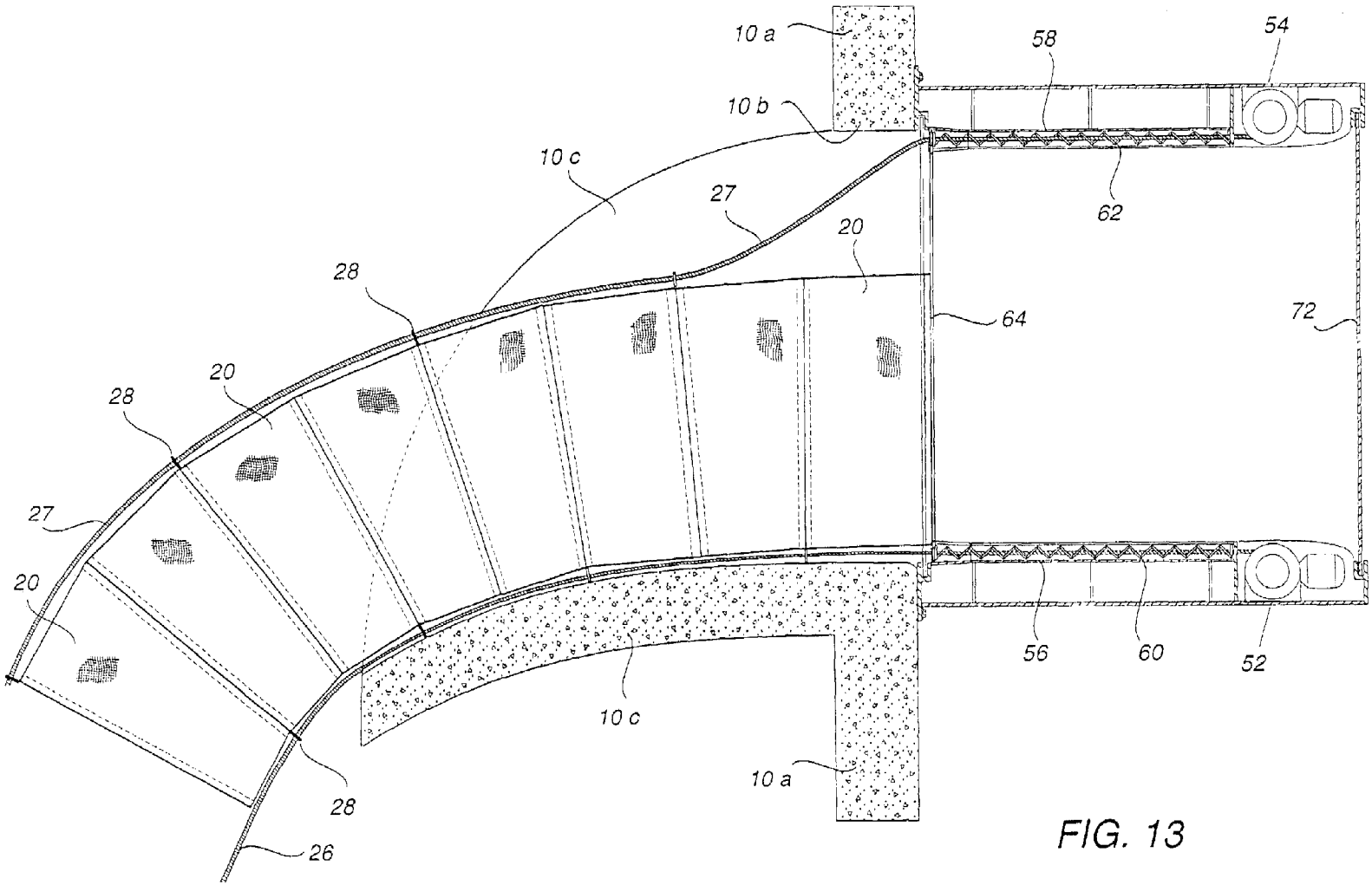
FIG. 13 is a sectional view similar to that of FIG. 7, following the ejection of the sleeve from the standby position.

Reference shall now be made to FIGS. 7–12. At every story of the building 10, next to an external wall 10*a*, a compartment generally denoted 50 will be installed, associated with a dedicated preferably oval opening 10*b* with a funnel-like extension 10*c* (FIG. 13).

The rescue sleeve 12 is shown in the folded, stand-by state, after the cables 26 and 27 have been fully rewound by respective electrically powered winch systems 52 and 54.

Cable 26 passes through a guiding tube 56, having for that purpose a somewhat flared opening portion 56*a*. The same applies with respect to tube 58 for cable 27.

Coil springs 60 and 62 are installed, both acting against a displaceable backup plate 64 (see FIG. 9) defining the surface against which the sleeve 12 is folded, in an accordion-like fashion.

Compartment 50 has an entering opening 64*a*, equal to or larger than the diameter of the sleeve 12.

Since the distance between the tubes 56 and 58 is greater than the diameter of sleeve 12, and in view of the alternate order of the eyelet 28 relative to the lower cable 26 and the upper cable 27, the sleeve sections 20 will become folded not overlapping each other, but in a staggered, zig-zag fashion, to save storing space.

The compartment 50 is made of metal construction, and is provided with a first, weather-proof sliding door 70 (see FIG. 10), a second sliding door 72, facing the interior of the building, and two pairs of third service sliding door systems 74*a*, 74*b* and 75*a*, 75*b* (see FIGS. 8 and 12) at both sides of the compartment 50, serving to allow access from the side for re-connecting the auxiliary anchor cables 18 after the use of the rescue sleeve and the cable having been cut and removed to facilitate smooth and trouble-free folding-back of the sleeve into its stand-by position.

The operation of the rescue-sleeve system is illustrated in FIG. 13. Hence, in case of emergency, the door 70 is pulled aside (see FIG. 10) and the winch systems 52 and 54 released for free wheel rotation of their drums. Consequently, under the force of the springs 60 and 62, the plate 64 will shoot (to the left in FIG. 7) and cause the folded sleeve to become ejected out through the opening 10*b* and paid down over the funnel shaped section 10*c* provided for that purpose.

Figure 14:
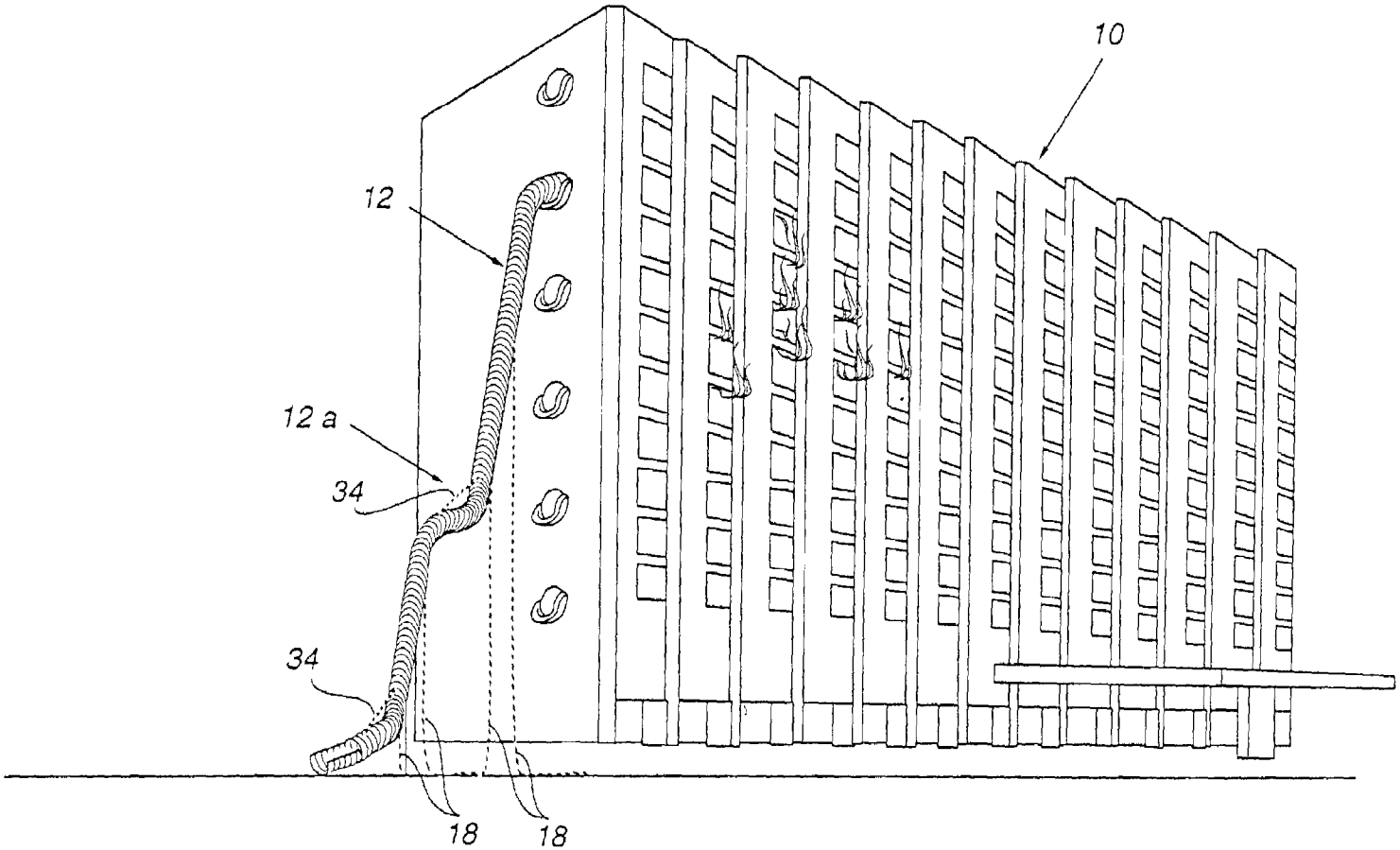
FIG. 14 shows the system in the sleeve deployed position prior to the anchoring as depicted in FIG. 1.

Now, the position of FIG. 14 is reached, where the sleeve 12 freely hangs down, except for the knee section(s) 34 that start shaping the sleeve towards the operative position of FIG. 1.

The auxiliary cables 18 (having been attached and prepared in the folded position of the sleeve as already explained) hang freely down as shown, ready to be picked up by the rescue team and tied to any available stationary object. The free end of the sleeve is tied by at-least the tension cable 27 as already explained with reference to FIG. 1 and the system is ready for its life saving goal.

While the above description contains many specificities, these should not be construed as limitations on the scope of the invention, but rather as exemplification of the preferred embodiments. Those skilled in the art will envision other possible variations that are within its scope. Accordingly, the scope of the invention should be determined not by the embodiment illustrated, but by the appended claims.

What is claimed is:

1. A system particularly useful for the evacuation of individuals from an elevated level of a building, comprising:

a flexible sleeve capable of being folded into a compact form for storage, or unfolded into an extended operative form for guiding the descent of an individual therethrough;

said flexible sleeve having an entry end to be secured with respect to the building at said elevated level, and an exit end to be secured to a stable object at a lower level in the extended operative form of the flexible sleeve;

said flexible sleeve including a plurality of annular sections interconnected together, each section being made of strong flexible sheet material attached to and supported by a rigid ring;

each of at least some of said rigid rings spaced along the length of said flexible sleeve carrying an eyelet extending upwardly from an upper portion of the respective rigid ring;

a tension cable passing through said eyelets, one end of said tension cable being fixed to the rigid ring at or adjacent to the exit end of the flexible sleeve, and the opposite end of said tension cable passing through the eyelet carried by the rigid ring at or adjacent to the entry end of said flexible sleeve for securement with respect to the building;

and at least one anchoring cable having one end to be secured to said rigid ring at or adjacent to the exit end of the flexible sleeve in the extended operative form of the flexible sleeve, and an opposite end to be secured to said stable object at said lower level;

wherein said system further comprises: a compartment for storing said flexible sleeve when in its compact form; a backing plate displaceable within said compartment; and a winch within said compartment, said opposite end of the tension cable being secured to said winch such that operation of the winch while the flexible sleeve is in its extended operative form draws the annular sections of the flexible sleeve into the compartment against said displaceable backing plate and folds the annular sections of the flexible sleeve into said compact form;

wherein each of at least some of said rigid rings spaced along the length of said flexible sleeve carries a downwardly-extending eyelet extending downwardly from a lower portion of the respective ring; said system further comprising a second tension cable passing through said downwardly-extending eyelets and having one end fixed to the rigid ring at or adjacent to the exit end of the flexible sleeve, and an opposite end passing through the downwardly-extending eyelet carried by the rigid ring at or adjacent to the entry end of the flexible sleeve for securement with respect to the building;

and wherein said compartment further includes: a second winch to which said opposite end of the second tension cable is secured; a guide tube for each of said tension cables located between its respective winch and said backing plate and guiding the displacement of said backing plate; a compression spring in each of said guide tubes biasing said backing plate in the direction of ejecting said flexible sleeve from said compartment; and a normally-closed door holding said flexible sleeve in its compact storage form within said compartment against the action of said springs.

2. The system according to claim 1, wherein said guide tubes are spaced apart within said compartment a greater distance than the corresponding transverse dimension of said annular sections of the flexible sleeve such that said annular sections are folded in a zig-zag space-saving fashion in said compartment.

3. The system according to claim 1, wherein each of said rigid rings at or adjacent to said exit end of the flexible sleeve carries a pair of anchoring elements, said system further including a pair of further anchoring cables, one for each pair of said anchoring elements.

4. The system according to claim 3, wherein each of said anchoring elements is in the form of an eyelet, and each of said further anchoring cables is of a length to permit the cable to be looped through the respective eyelet for securing the cable thereto, and to be fixed at its opposite ends to said stable object.

5. The system according to claim 1, wherein the system further comprises at least one constraining cable secured at its opposite ends to the upwardly-extending eyelets in two spaced rigid rings such as to constrain the portion of the flexible sleeve between said spaced rigid rings to a predetermined curve to decelerate the descent of an individual therethrough.

6. The system according to claim 1, wherein said flexible sleeve further comprises a plurality of interconnected semi-annular sections at the exit end of the flexible sleeve, each of said semi-annular sections including flexible sheet material attached to a semi-annular rigid ring.

7. The system according to claim 6, wherein said semi-annular section at least at the exit end of said flexible sleeve includes a cushion for cushioning the descent of an individual descending therethrough.

8. A system particularly useful for the evacuation of individuals from an elevated level of a building, comprising:

a flexible sleeve capable of being folded into a compact storage form, or unfolded into an extended operative form defining a tube for guiding the descent of an individual therethrough;

said flexible sleeve having an entry end to be secured to the building at said elevated level, and an exit end to be secured to a fixed object at a lower level in the extended operative form of the flexible sleeve;

said flexible sleeve including a plurality of annular sections interconnected together, each section being made of strong flexible sheet material attached to and supported by a rigid ring;

each of at least some of said rigid rings carrying an eyelet extending upwardly from an upper portion of the respective rigid ring;

an upper tension cable passing through said upwardly-extending eyelets, one end of said upper tension cable being fixed to the respective rigid ring at or adjacent to the exit end of the flexible sleeve, and the opposite end of said upper tension cable passing through the eyelet carried by the respective rigid ring at or adjacent to the entry end of the flexible sleeve for securement with respect to the building;

a compartment for receiving said flexible sleeve when in its compact storage form;

a backing plate displaceable within said compartment;

and a winch in said compartment secured to said opposite end of said upper tension cable such that operation of said winch while the flexible sleeve is in its extended operative form, draws the annular sections of the flexible sleeve into said compartment against said displaceable backing plate and folds them into said compact storage form;

wherein:

each of at least some of said rigid rings also carries an eyelet extending downwardly from a lower portion of the respective rigid ring;

a lower tension cable passes through said downwardly-extending eyelets and has one end fixed to a rigid ring at or adjacent to the exit end of the flexible sleeve, and an opposite end passing through an eyelet carried by the respective rigid ring at or adjacent to the entry end of the flexible sleeve for securement with respect to the building;

and wherein said compartment includes a guide tube for each of said tension cables located between said backing plate and the respective winch; said guide tubes being spaced apart a greater distance than the corresponding transverse dimension of said annular sections of the flexible sleeve such that said annular sections are folded in a zig-zag space-saving fashion in said compartment by the operation of said winches.

9. The system according to claim 8, wherein said system further includes a compression spring in each of said guide tubes biasing said backing plate in the direction of ejecting said flexible sleeve from said compartment, and a normally-closed door holding said flexible sleeve in its compact storage form within said compartment against the action of said springs.

10. The system according to claim 8, wherein at least one of said rigid rings at or adjacent to the exit end of said flexible sleeve carries a pair of laterally-extending anchoring elements, one at each of the opposite sides of the rigid ring;

said system further comprising a pair of anchoring cables each having one end to be secured to one of said anchoring elements in the extended operative form of the flexible sleeve, and an opposite end to be secured to a stable object at said lower level.

11. The system according to claim 10, wherein said system comprises a further anchoring cable having one end to be secured to said upper tension cable at or adjacent to the exit end of the flexible sleeve in the extended operative form of the flexible sleeve, and an opposite end to be secured to said stable object at said lower level;

each of a plurality of said rigid rings adjacent to said exit end of the flexible sleeve carry a pair of said anchoring elements, said system further including a plurality of pairs of anchoring cables, one for each pair of said anchoring elements.

12. The system according to claim 10, wherein each of said anchoring elements is in the form of an eyelet, and each of said anchoring cables is of a length to permit the cable to be looped through the respective eyelet for securing the cable thereto, and to be fixed at its opposite ends to said stable object.

13. A system particularly useful for the evacuation of individuals from an elevated level of a building, comprising:

a flexible sleeve capable of being folded into a compact form for storage, or unfolded into an extended operative form for guiding the descent of an individual therethrough;

said flexible sleeve having an entry end to be secured with respect to the building at said elevated level, and an exit end to be secured to a stable object at a lower level in the extended operative form of the flexible sleeve;

upper and lower tension cables coupled to the upper and lower portions of said flexible sleeve for supporting the flexible sleeve at an incline in its extended operative form;

a compartment for storing said flexible sleeve when in its compact form;

first and second winches in said compartment coupled to said upper and lower tension cables for drawing said flexible sleeve into said compartment;

first and second tubular guides for said tension cables located between each respective winch and said flexible sleeve;

a backing plate linearly displaceable within said compartment and engageable with said entry end of the flexible sleeve, said tubular guides passing through said backing plate;

a compression spring for each of said tubular guides effective to urge said backing plate in the direction of ejecting said flexible sleeve from said compartment;

and a normally-closed door holding said flexible sleeve in its compact storage form within said compartment against the action of said springs.

14. The system according to claim 13 wherein said guides are spaced apart within said compartment a greater distance than the transverse dimension of said flexible sleeve such that said flexible sleeve is folded in a zig-zag space-saving fashion when drawn into said compartment by said winches.

15. The system according to claim 13, wherein said flexible sleeve includes a plurality of annular sections interconnected together, each section being made of strong flexible sheet material attached to and supported by a rigid ring; and wherein said upper and lower tension cables pass through eyelets carried by the upper and lower portions of said rigid rings.

* * * * *